US010101702B2

(12) United States Patent
Yamamoto

(10) Patent No.: US 10,101,702 B2
(45) Date of Patent: Oct. 16, 2018

(54) IMAGE FORMING APPARATUS

(71) Applicant: KYOCERA Document Solutions Inc., Osaka (JP)

(72) Inventor: Kiyonori Yamamoto, Osaka (JP)

(73) Assignee: KYOCERA Document Solutions Inc., Tamatsukun, Chuo-ku, Osaka (JP)

( * ) Notice: Subject to any disclaimer, the term of this patent is extended or adjusted under 35 U.S.C. 154(b) by 0 days.

(21) Appl. No.: 15/195,564

(22) Filed: Jun. 28, 2016

(65) Prior Publication Data

US 2017/0003625 A1 Jan. 5, 2017

(30) Foreign Application Priority Data

Jun. 30, 2015 (JP) ..... 2015-131395

(51) Int. Cl.
*G03G 15/14* (2006.01)
*G03G 15/00* (2006.01)
*G03G 15/16* (2006.01)

(52) U.S. Cl.
CPC ..... *G03G 15/6532* (2013.01); *G03G 15/161* (2013.01)

(58) Field of Classification Search
CPC ..... G03G 15/161; G03G 15/6532
USPC ..... 399/398, 399
See application file for complete search history.

(56) References Cited

U.S. PATENT DOCUMENTS 7,606,507 B2 * 10/2009 Soshiroda ..... G03G 15/161 399/121
2007/0116498 A1 * 5/2007 Nakano ..... G03G 15/2028 399/323
2011/0188905 A1 * 8/2011 Shinkawa ..... G03G 15/20 399/323
2016/0016741 A1 * 1/2016 Lee ..... B65H 5/068 271/10.09

FOREIGN PATENT DOCUMENTS

JP H01-128080 A 5/1989
JP 2002-251074 A 9/2002

* cited by examiner

*Primary Examiner* — Blake A Tankersley
*Assistant Examiner* — Quang X Nguyen
(74) *Attorney, Agent, or Firm* — IP Business Solutions, LLC

(57) ABSTRACT

A separating claw unit includes: a separating claw provided beside and against a surface of an image carrier on which a toner image to be transferred to a recording paper sheet in a nip area between the image carrier and a transfer section is to be formed, the separating claw being configured to separate the recording paper sheet having passed through the nip area off the surface of the image carrier in a direction away from the surface of the image carrier; and a cushion guide provided next to the separating claw to extend beyond the separating claw in the direction away from the surface of the image carrier, held elastically and displaceably away from the surface of the image carrier, and configured to come into contact with the recording paper sheet to guide the recording paper sheet downstream in a direction of conveyance of the recording paper sheet.

3 Claims, 11 Drawing Sheets

IMAGE FORMING APPARATUS

INCORPORATION BY REFERENCE

This application claims priority to Japanese Patent Application No. 2015-131395 filed on Jun. 30, 2015, the entire contents of which are incorporated by reference herein.

BACKGROUND

The present disclosure relates to a technique for peeling a recording paper sheet off an image carrier.

In a general image forming apparatus, a toner image is formed on a photosensitive drum (image carrier), the photosensitive drum is rotated with a transfer roller pressed against the photosensitive drum to form a nip area between the photosensitive drum and the transfer roller, a recording paper sheet is caught in the nip area to transfer the toner image from the photosensitive drum to the recording paper sheet, and the toner image on the recording paper sheet is then fixed by the application of heat and pressure.

After passing through the nip area, the recording paper sheet is peeled off the photosensitive drum and further conveyed. However, if the recording paper sheet cannot be peeled off the photosensitive drum, it wraps around the photosensitive drum and becomes jammed. To cope with this, separating claws are provided downstream of the nip area in the direction of conveyance of the recording paper sheet to rest against the surface of the photosensitive drum. The separating claws can certainly peel the recording paper sheet off the photosensitive drum.

There are known many image forming apparatuses provided with such separating claws. Among them, an image forming apparatus is proposed in which a sheet trailing end restricting member is provided to extend beyond each separating claw toward a conveyance path for a recording paper sheet so that when the trailing end portion of the recording paper sheet comes close to the separating claw, it strikes the sheet trailing end restricting member but does not strike the separating claw. Toner remaining on the surface of the photosensitive drum sometimes adheres to and becomes deposited on the separating claws. If in this situation the trailing end portion of the recording paper sheet strikes the separating claws, it is contaminated with the toner. The sheet trailing end restricting members are provided in order to prevent such contamination of the trailing end portion of the recording paper sheet.

Alternatively, a star-shaped roller is provided to extend beyond each separating claw toward the conveyance path for the recording paper sheet so that the trailing end portion of the recording paper sheet can strike the star-shaped roller but does not strike the separating claw, thus preventing contamination of the trailing end portion of the recording paper sheet.

SUMMARY

A technique improved over the above techniques is proposed herein as one aspect of the present disclosure.

A separating claw unit according to an aspect of the present disclosure includes a separating claw and a cushion guide.

The separating claw is provided beside and against a surface of an image carrier on which a toner image to be transferred to a recording paper sheet in a nip area between the image carrier and a transfer section is to be formed, the separating claw being configured to separate the recording paper sheet having passed through the nip area off the surface of the image carrier in a direction away from the surface of the image carrier.

The cushion guide is provided next to the separating claw to extend beyond the separating claw in the direction away from the surface of the image carrier, held elastically and displaceably away from the surface of the image carrier, and configured to come into contact with the recording paper sheet to guide the recording paper sheet downstream in a direction of conveyance of the recording paper sheet.

An image forming apparatus according to another aspect of the present disclosure includes the above-described image carrier, the above-described transfer section, and the above-described separating claw.

The image carrier is configured to carry a toner image formed thereon.

The transfer section is configured to be pressed against the image carrier to form a nip area with the image carrier and transfer the toner image on the image carrier to a recording paper sheet being conveyed through the nip area.

DETAILED DESCRIPTION

Figure 1:
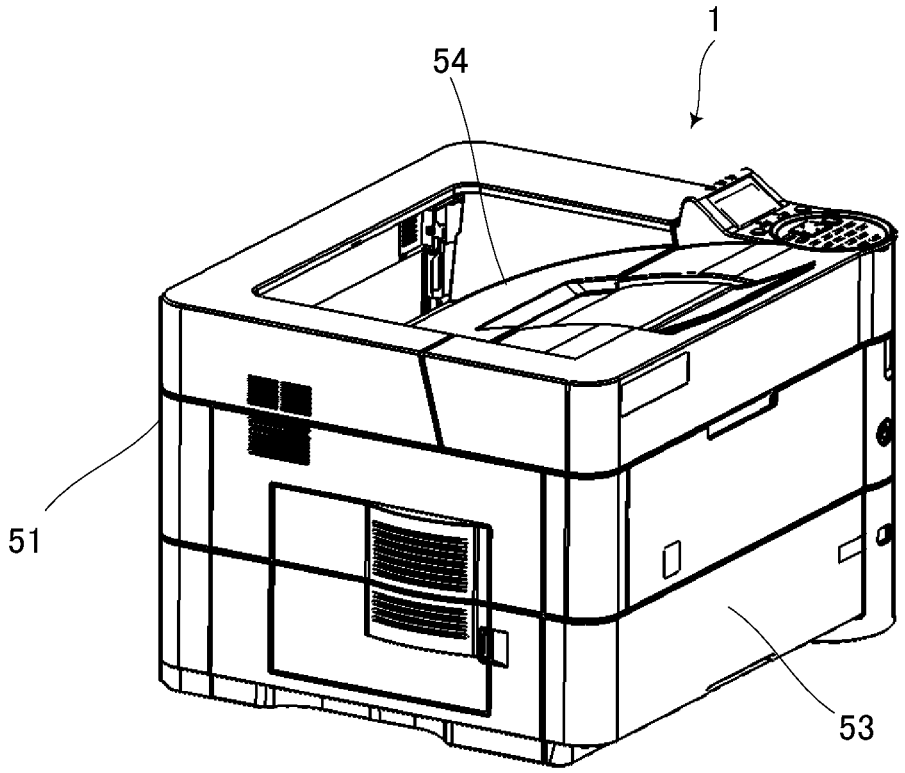
FIG. 1 is a perspective view showing an appearance of an image forming apparatus according to one embodiment of the present disclosure.

Hereinafter, a description will be given of a separating claw unit and an image forming apparatus according to one embodiment of the present disclosure with reference to the drawings. FIG. 1 is a perspective view showing an appearance of an image forming apparatus according to one embodiment of the present disclosure.

A housing 51 forming a shell of an image forming apparatus 1 shown in FIG. 1 is provided with a plurality of components for implementing various functions of the image forming apparatus 1. For example, the housing 51 is provided with an image forming section, a fixing section, an operating section, a sheet feed section 53, a sheet output tray 54, and so on.

The image forming section includes a process unit, an exposure section, a transfer section, and so on and is configured to form (print) an image represented by image data received by a data communication section on a recording paper sheet fed from the sheet feed section 53. The recording paper sheet having an image formed thereon is subjected to fixation processing by the fixing section and then discharged to the sheet output tray 54.

Figure 2:
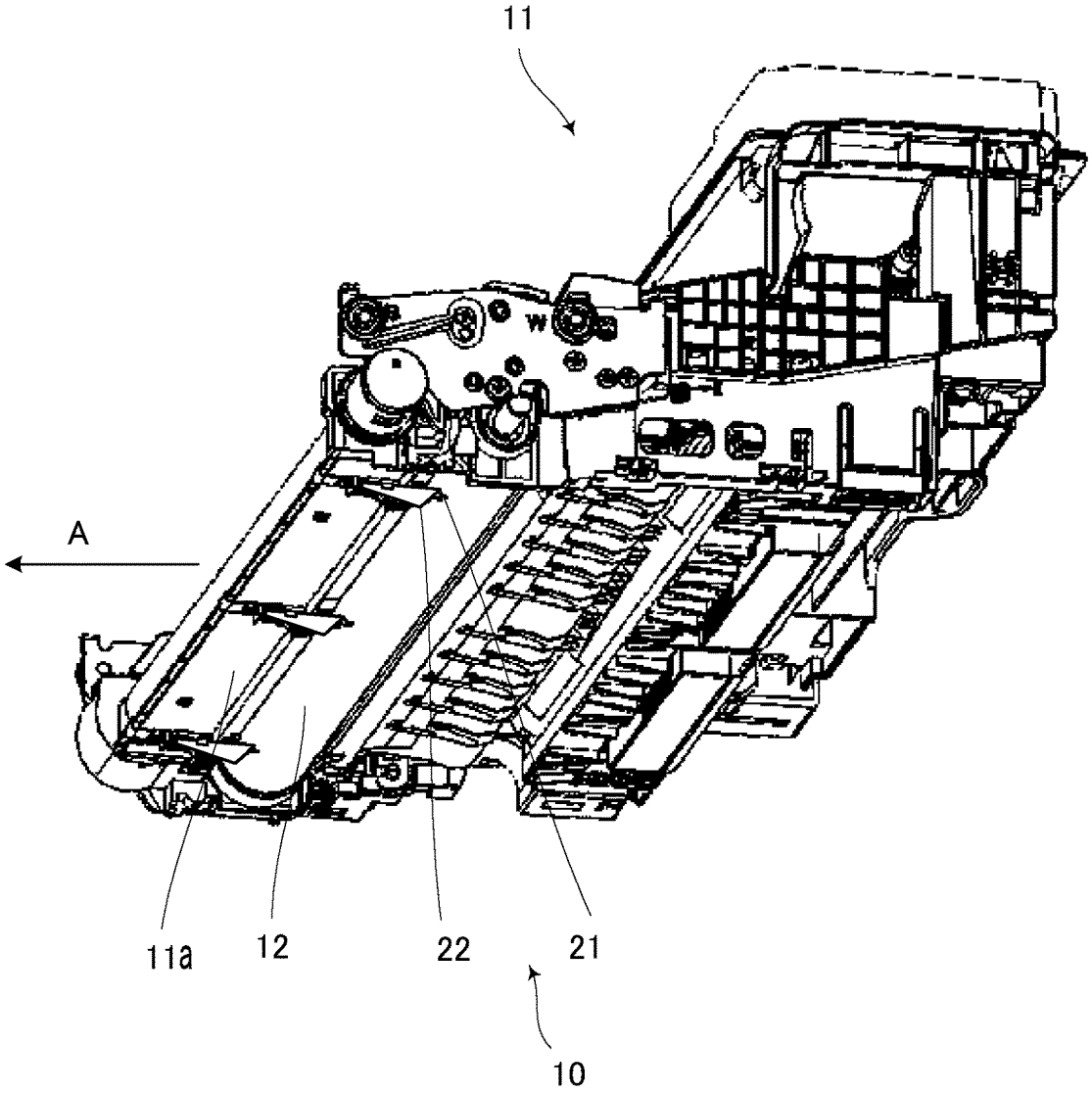
FIG. 2 is a perspective view showing a process unit of the image forming apparatus according to the one embodiment of the present disclosure.
Figure 3:
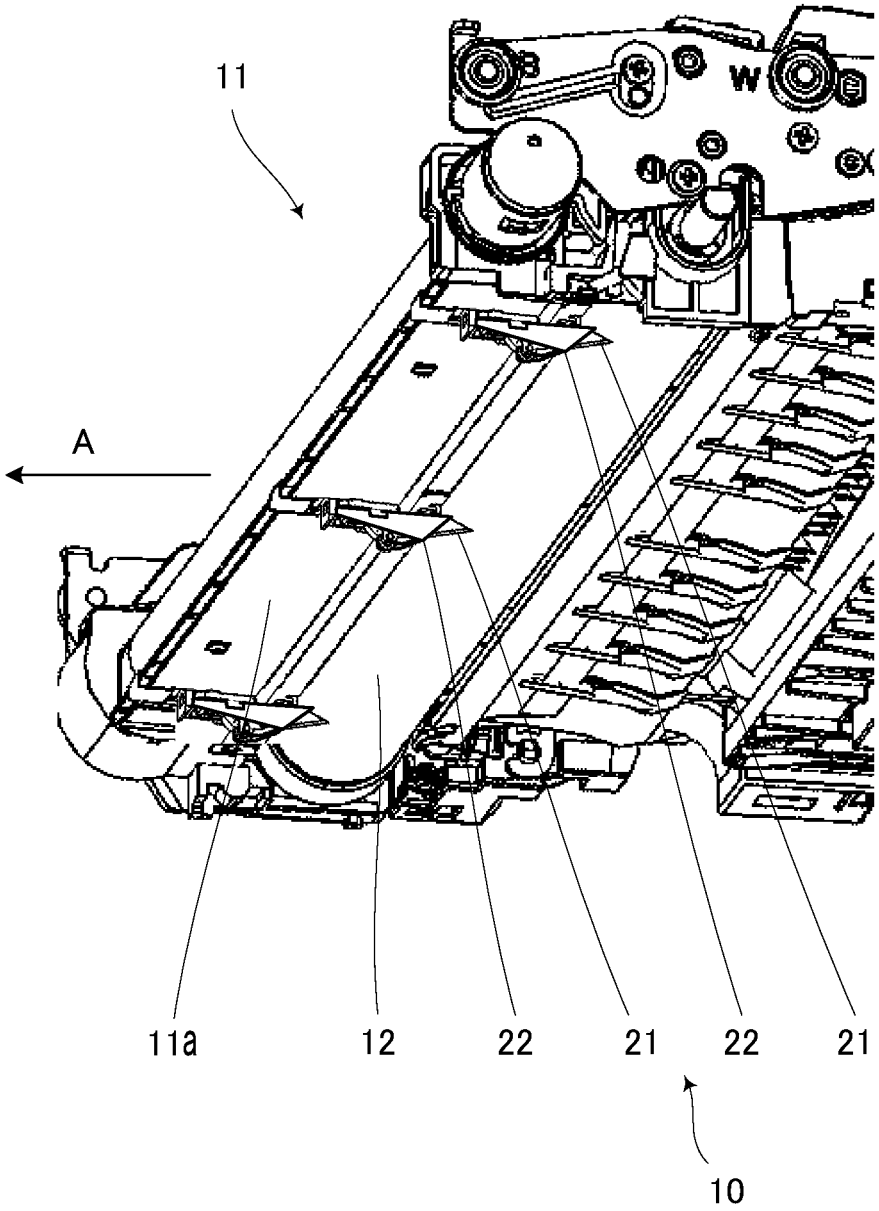
FIG. 3 is an enlarged perspective view of part of the process unit.
Figure 4:
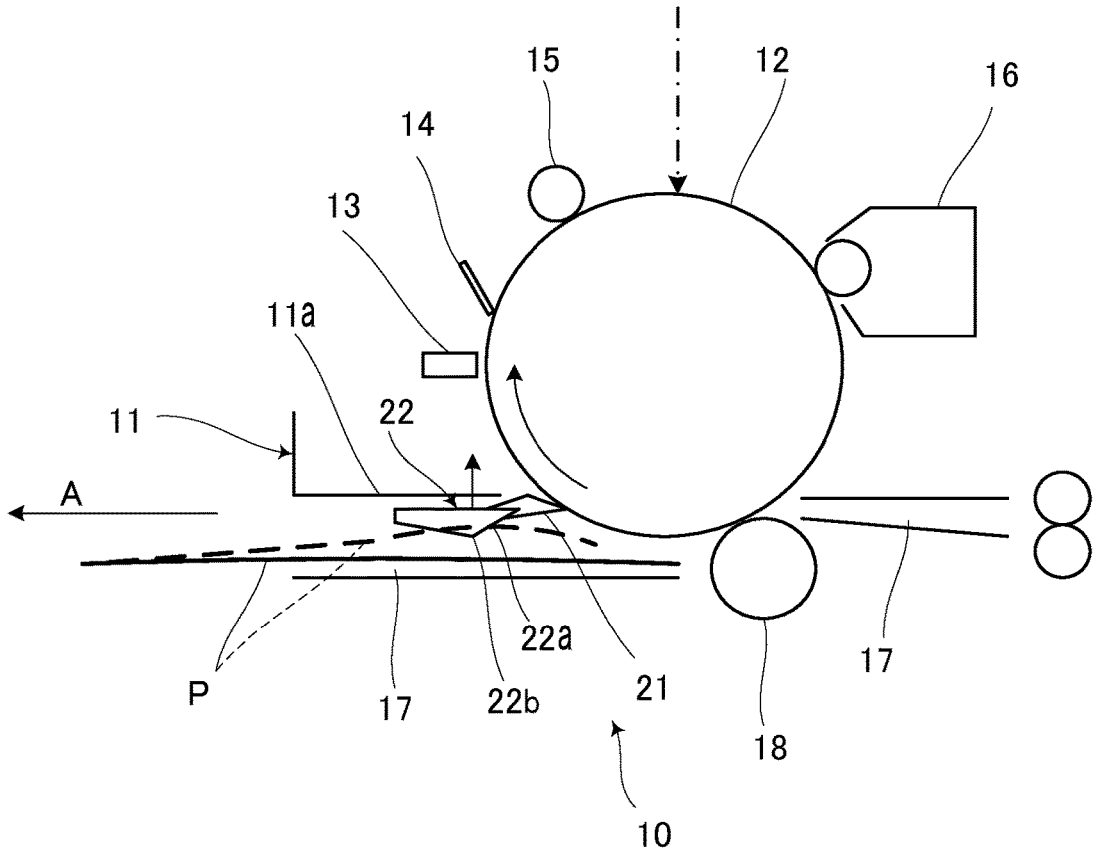
FIG. 4 is a side view schematically showing the structure of the process unit.

FIG. 2 is a perspective view showing the process unit of the image forming apparatus according to the one embodiment of the present disclosure. FIG. 3 is an enlarged perspective view of part of the process unit. FIG. 4 is a side view schematically showing the structure of the process unit.

The process unit (image forming unit) 11 is used for forming a toner image by electrophotography on a recording paper sheet fed from the sheet feed section 53 and includes: a photosensitive drum 12 rotatable in the direction of the arrow; a static eliminating section 13 configured to eliminate electric charge on the surface of the photosensitive drum 12; a cleaning section 14 configured to clean the surface of the photosensitive drum 12; a charging section 15 configured to uniformly charge the surface of the photosensitive drum 12; a developing section 16 configured to develop an electrostatic latent image formed on the surface of the photosensitive drum 12 by irradiation of light from the exposure section into a toner image; and so on. The process unit 11 is configured to form the toner image on the surface of the photosensitive drum 12.

Furthermore, the photosensitive drum 12 is exposed at the underside of the process unit 11 and pressed against a transfer roller 18 provided under the photosensitive drum 12 to form a nip area between the photosensitive drum 12 and the transfer roller 18.

In the image forming apparatus 1, a conveyance path 17 for a recording paper sheet P is provided under the process unit 11. When a recording paper sheet P is fed from the sheet feed section 53, it is conveyed along the conveyance path 17 in the direction of the arrow A. The recording paper sheet P conveyed in the direction of the arrow A is passed through the nip area between the photosensitive drum 12 and the transfer roller 18 and, therein, the toner image on the surface of the photosensitive drum 12 is transferred to the recording paper sheet P. Subsequently, the recording paper sheet P is conveyed along the conveyance path 17 to the fixing section and heat and pressure are applied to the recording paper sheet P by the fixing section, so that the toner image on the recording paper sheet P is fixed. Furthermore, the recording paper sheet P is conveyed along a conveyance path curved upward from the fixing section and then discharged to the sheet output tray 54 provided on the top of the image forming apparatus 1.

Additionally, three separating claws 21 are provided downstream of the nip area between the photosensitive drum 12 and the transfer roller 18 in the direction of conveyance of the recording paper sheet P (the direction of the arrow A). The three separating claws 21 are spaced apart from one another in the longitudinal direction of the photosensitive drum 12. The separating claws 21 are provided on a bottom plate (the outline portion) 11*a* of the process unit 11 and their distal ends are disposed beside and against the surface of the photosensitive drum 12.

Each separating claw 21 is provided beside and against the surface of the photosensitive drum 12 and configured to separate the recording paper sheet P having passed through the nip area off the surface of the photosensitive drum 12 in the direction away from the surface of the photosensitive drum 12. After passing through the nip area between the photosensitive drum 12 and the transfer roller 18, the recording paper sheet P peels off from the photosensitive drum 12 and is further conveyed. However, even when the recording paper sheet P has not peeled off from the photosensitive drum 12, the distal ends of the separating claws 21 enter between the recording paper sheet P having passed through the nip area and the surface of the photosensitive drum 12 to peel the recording paper sheet P off the surface of the photosensitive drum 12. Thus, the recording paper sheet P is prevented from wrapping around the photosensitive drum 12 and in turn being jammed.

Meanwhile, since the distal ends of the separating claws 21 are disposed beside and against the surface of the photosensitive drum 12, toner remaining on the surface of the photosensitive drum 12 adheres to and becomes deposited on the distal ends of the separating claws 21. Furthermore, as shown in FIG. 4, just after passing through the nip area between the photosensitive drum 12 and the transfer roller 18, the trailing end portion of the recording paper sheet P may bounce up by the elasticity of the recording paper sheet P. In conventional techniques, when the bouncing trailing end portion of the recording paper sheet P directly strikes the separating claws 21, the separating claws 21 are subjected to impact of the strike to drop the toner deposited thereon, so that the trailing end portion of the recording paper sheet P is contaminated with the dropped toner.

To cope with this, in this embodiment, cushion guides 22 are provided, one close to each separating claw 21. The cushion guides 22 are provided next to the respective associated separating claws 21 to extend beyond the separating claws 21 toward the conveyance path 17 for the recording paper sheet P and held elastically and displaceably toward and away from the conveyance path 17. The cushion guides 22 function to come into contact with the bouncing trailing end portion of the recording paper sheet P to cushion the impact, thus preventing dropping of toner deposited on the separating claws 21. The separating claw 21 is an example of the separating claw defined in What is claimed is and the cushion guide 22 is an example of the cushion guide defined in What is claimed is. The separating claws 21 and the cushion guides 22 form a separating claw unit 10.

Figure 5:
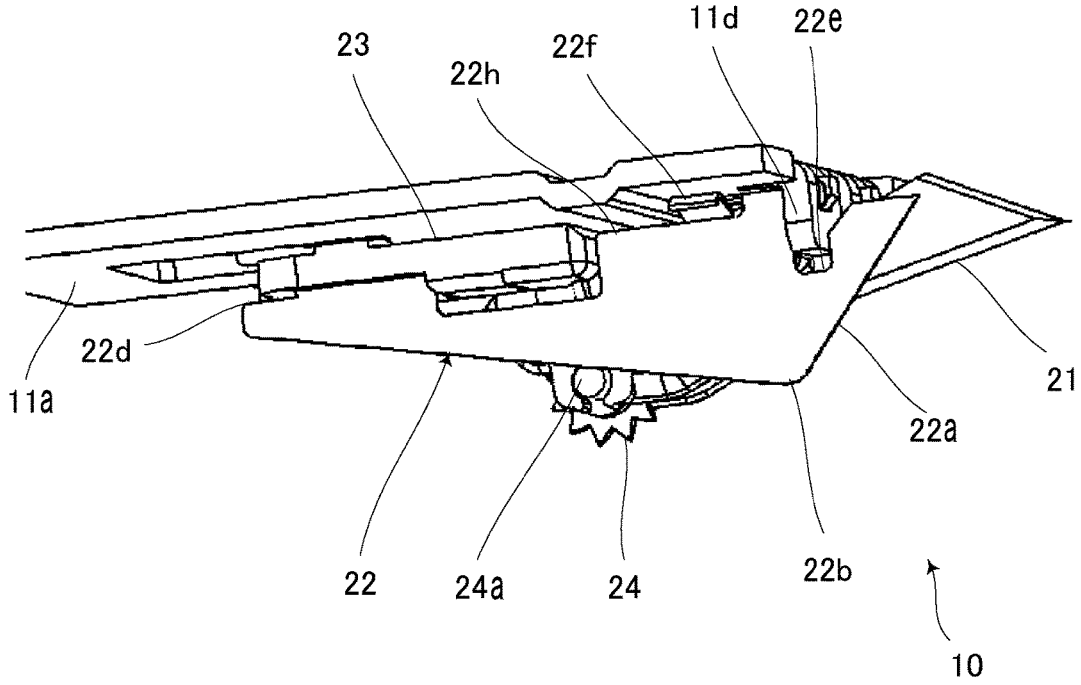
FIG. 5 is an enlarged perspective view showing a state where a separating claw and a cushion guide are attached to a bottom plate of the process unit.
Figure 6:
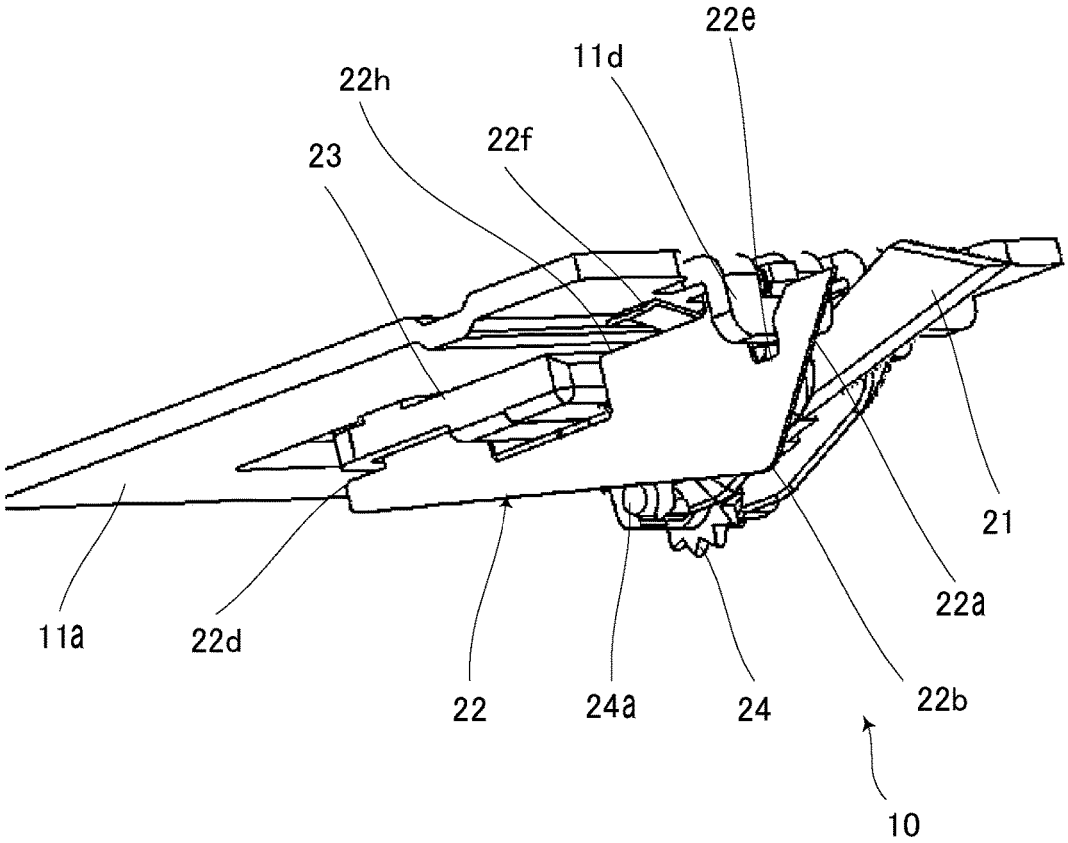
FIG. 6 is another enlarged perspective view showing the state where the separating claw and the cushion guide are attached to the bottom plate of the process unit, as viewed at a different angle from FIG. 5.
Figure 7:
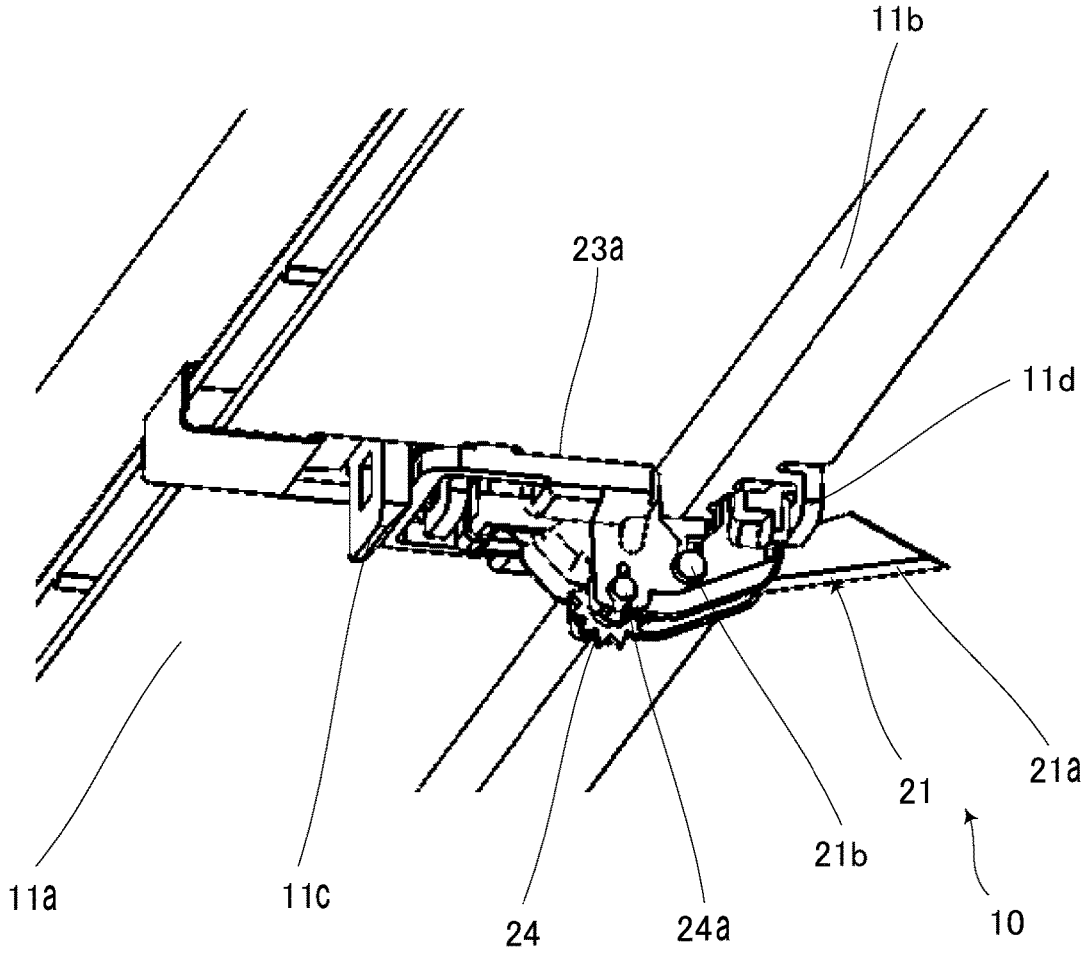
FIG. 7 is an enlarged perspective view showing a state where only the separating claw is attached to the bottom plate of the process unit.
Figure 8A:
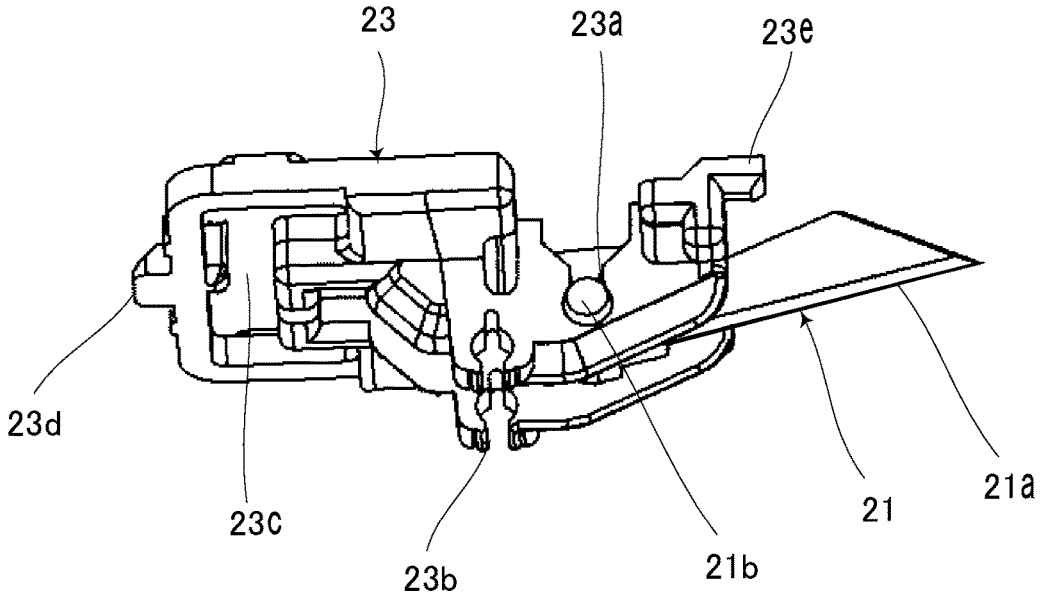
FIG. 8A is a perspective view showing the separating claw and a holder for the separating claw.
Figure 8B:
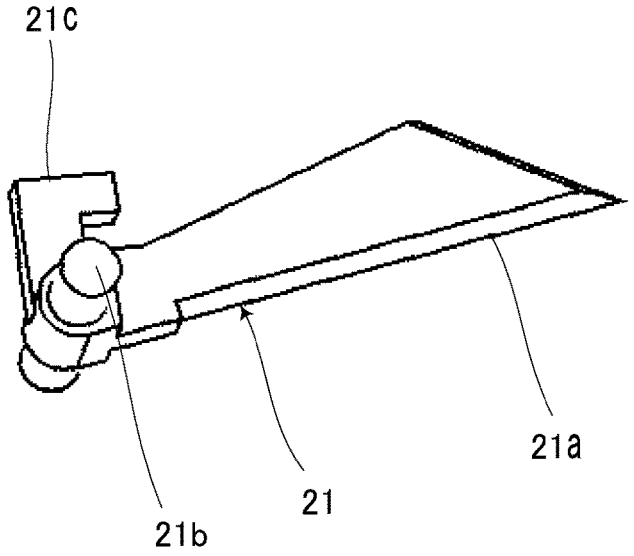
FIG. 8B is a perspective view showing the separating claw.
Figure 9A:
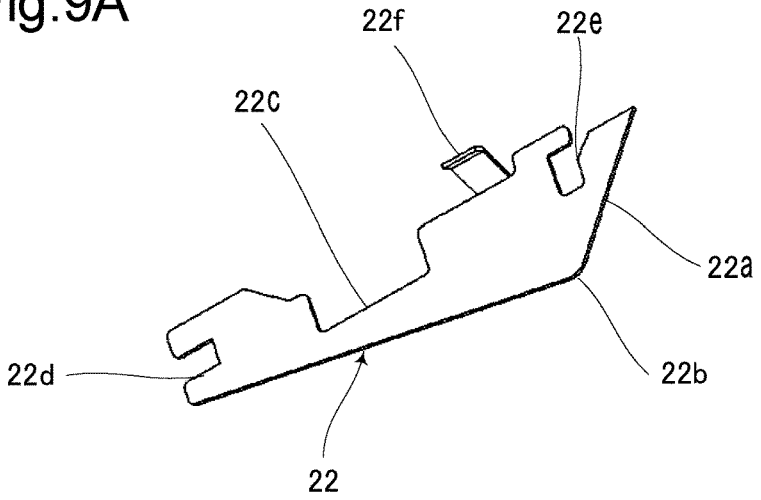
FIGS. 9A, 9B, and 9C are perspective views of the cushion guide as viewed from different angles.
Figure 9B:
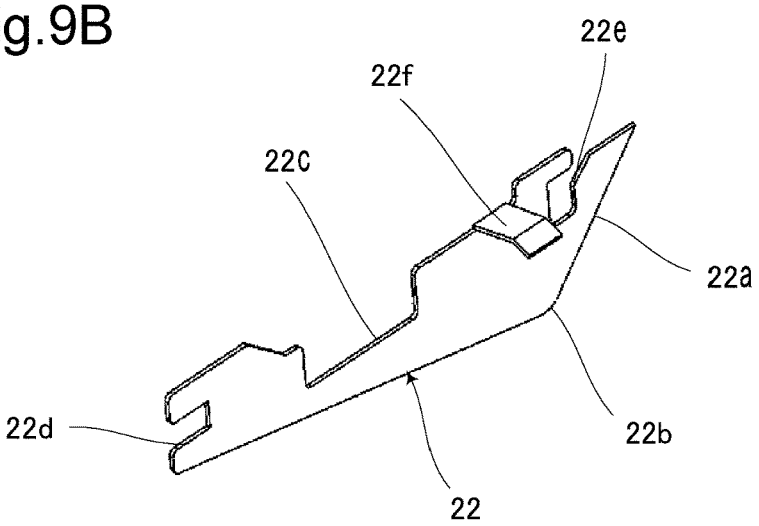
Figure 9C:
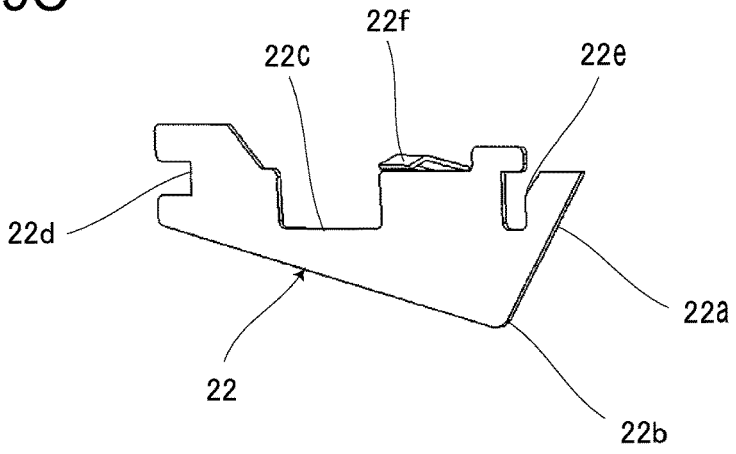

Next, the separating claws 21, the cushion guides 22, and so on will be described sequentially in detail. FIGS. 5 and 6 are enlarged perspective views showing a state where a pair of separating claw 21 and cushion guide 22 is attached to the bottom plate 11*a* of the process unit 11, as viewed at different angles from upstream in the direction of conveyance of the recording paper sheet P. FIG. 7 is an enlarged perspective view showing a state where only the separating claw 21 is attached to the bottom plate 11*a* of the process unit 11, as viewed from downstream in the direction of conveyance of the recording paper sheet P. Furthermore, FIG. 8A is a perspective view showing the separating claw 21 and a holder 23 for the separating claw 21 and FIG. 8B is a perspective view showing the separating claw 21. Moreover, FIGS. 9A, 9B, and 9C are perspective views of the cushion guide 22 as viewed from different angles.

As shown in FIGS. 8A and 8B, the separating claw 21 is supported by a holder 23. The separating claw 21 includes a claw portion 21*a*, a pin 21*b*, and a hook portion 21*c*, wherein the pin 21*b* and the hook portion 21*c* are provided at a root end of the claw portion 21*a*. The holder 23 includes a bearing portion 23*a* supporting the pin 21*b* of the separating claw 21 to allow the rotation of the pin 21*b*, a bearing portion 23*b* supporting a pin 24*a* of a star-shaped roller 24 (see FIGS. 5 and 6) to allow the rotation of the pin 24*a*, an opening 23*c*, and two engagement portions 23*d*, 23*e* through which the holder 23 is attached to the bottom plate 11*a* of the process unit 11.

The separating claw 21 is rotatably attached to the holder 23 by fitting the pin 21*b* of the separating claw 21 into the bearing portion 23*a* of the holder 23. When in this state the separating claw 21 is angularly moved up and down about the pin 21*b*, the hook portion 21*c* of the separating claw 21 abuts against a stopper (not shown) of the holder 23 to restrict the range of angular movement (rotation angles) of the separating claw 21. For example, by urging the separating claw 21 around the pin 21*b* by a spring (not shown) or the like, the claw portion 21*a* of the separating claw 21 is disposed beside and against the surface of the photosensitive drum 12.

Furthermore, the star-shaped roller 24 is rotatably attached to the holder 23 by fitting the pin 24*a* of the star-shaped roller 24 into the bearing portion 23*b* of the holder 23.

In this relation, as shown in FIG. 7, the bottom plate 11*a* of the process unit 11 is provided with a shoulder 11*b* and two holding portions 11*c*, 11*d* spaced apart in the direction of conveyance of the recording paper sheet P with the shoulder 11*b* in between. The holder 23 is attached to the bottom plate 11*a* of the process unit 11 in such a manner that, with the holder 23 held against the bottom plate 11*a* and the shoulder 11*b* of the process unit 11, one engagement portion 23*d* of the holder 23 is engaged into a hole of one holding portion 11*c* of the bottom plate 11*a* and the other engagement portion 23*e* of the holder 23 is engaged into a hole of the other holding portion 11*d* of the bottom plate 11*a*.

Referring next to FIGS. 9A, 9B, and 9C, the cushion guide 22 is formed by cutting and bending a plate-like member. The cushion guide 22 extends beyond the associated separating claw 21 in the direction away from the surface of the photosensitive drum 12. The cushion guide 22 is provided next to the separating claw 21 and held elastically and displaceably away from the surface of the photosensitive drum 12. The cushion guide 22 is configured to come into contact with the recording paper sheet P to guide the recording paper sheet P downstream in the direction of conveyance of the recording paper sheet P.

The cushion guide 22 formed of a plate-like member is provided in a position perpendicular to the surface of the photosensitive drum 12. The cushion guide 22 has a substantially triangular shape and includes a guiding inclined edge 22*a*, an extending edge 22*b*, a cutaway 22*c*, a rear end engagement recess 22*d*, a front end engagement recess 22*e*, and a leaf spring portion 22*f* The leaf spring portion 22*f* is formed by bending a portion of the plate-like member forming the cushion guide 22.

As shown in FIGS. 5 and 6, the cushion guide 22 extends in the direction of conveyance of the recording paper sheet P and its front end portion located on the upstream side thereof in the direction of conveyance has the guiding inclined edge 22*a* inclined to guide the leading end of the recording paper sheet P in the direction of conveyance to move it away from the surface of the photosensitive drum 12.

The front end portion of the cushion guide 22 is provided at a side edge 22*h* thereof with the recess 22*e* cut in the direction away from the surface of the photosensitive drum 12. The bottom plate 11*a* of the process unit 11 is provided at a portion thereof facing the recess 22*e* with the holding portion (the extending portion) 11*d* having a greater amount of extension in the direction away from the bottom plate 11*a* than the amount of cutaway of the recess 22*e* in the direction away from the bottom plate 11*a*.

The leaf spring portion 22*f* is connected at its root end to the side edge 22*h* of the front end portion of the cushion guide 22 located on the upstream side thereof in the direction of conveyance, the side edge 22*h* being close to the surface of the photosensitive drum 12. Furthermore, the other end of the leaf spring portion 22*f* extending from the side edge 22*h* is pressed against the bottom plate 11*a* of the process unit 11 holding the cushion guide 22 and the photosensitive drum 12. Since in this manner the distal end of the leaf spring portion 22*f* is pressed against the bottom plate 11*a*, the front end portion of the cushion guide 22 is kept away from the bottom plate 11*a* and the surface of the photosensitive drum 12 while the holding portion 11*d* is inserted in the recess 22*e* but held out of contact with the bottom of the recess 22*e*.

Specifically, the rear end engagement recess 22*d* of the cushion guide 22 is inserted into the opening 23*c* of the holder 23 and engaged with an inside edge of the opening 23*c* and the front end engagement recess 22*e* of the cushion guide 22 is engaged with the holding portion 11*d* of the bottom plate 11*a* of the process unit 11, so that the cushion guide 22 is attached to the holder 23 and the bottom plate 11*a* of the process unit 11. Thus, the rear end portion of the cushion guide 22 located on the downstream side thereof in the direction of conveyance is mounted to the bottom plate 11*a* angularly movably with the rear end portion as a fulcrum. Therefore, the above angularly movable configuration of the cushion guide 22 and the leaf spring portion 22*f* pressed against the bottom plate 11*a* of the process unit 11 allow the cushion guide 22 to be elastically held while urged downward by the leaf spring portion 22*f*.

In this state, an amount of play is present between the bottom of the front end engagement recess 22*e* of the cushion guide 22 and the distal end of the holding portion 11*d* of the bottom plate 11*a* of the process unit 11. Thus, the front end portion of the cushion guide 22 can move up and down by the amount of play. Therefore, the cushion guide 22 is angularly movable up and down, i.e., displaceable toward and away from the conveyance path 17, with the engagement position between the rear end engagement recess 22*d* of the cushion guide 22 and the inside edge of the opening 23*c* of the holder 23 as the center of angular movement.

When the cushion guide 22 angularly moves in the above manner so that its front end portion moves toward the bottom plate (the outline portion) 11*a* and the surface of the photosensitive drum 12, the bottom of the front end engagement recess 22*e* abuts against the distal end of the holding portion (the extending portion) 11*d* to restrict further angular movement of the cushion guide 22. By the above abutment, the extending edge 22*b* of the cushion guide 22, which is an edge portion thereof located farthest away from the bottom plate (the outline portion) 11*a* and the photosensitive drum 12, is kept extending beyond the separating claw 21 in the direction away from the surface of the photosensitive drum 12.

When in this configuration the recording paper sheet P passes through the nip area between the photosensitive drum 12 and the transfer roller 18 as shown in FIG. 4, the distal ends of the separating claws 21 enter between the recording paper sheet P and the surface of the photosensitive drum 12 to peel the recording paper sheet P off the surface of the photosensitive drum 12. Subsequently, the recording paper sheet P is smoothly guided to the conveyance path 17 by the guiding inclined edges (the inclined portions) 22*a* of the cushion guides 22 and conveyed along the conveyance path 17. In addition, even if the recording paper sheet P comes close to the bottom plate 11*a* of the process unit 11, it touches the star-shaped rollers 24, so that the recording paper sheet P can be conveyed along the conveyance path 17 without touching the separating claws 21.

If, after passing through the nip area between the photosensitive drum 12 and the transfer roller 18, the trailing end portion of the recording paper sheet P bounces up by the elasticity of the recording paper sheet P, the bouncing trailing end portion of the recording paper sheet P strikes the inclined edges 22*a* and extending edges 22*b* of the cushion guides 22. When in this manner the recording paper sheet P strikes the cushion guides 22, the cushion guides 22 angularly move with their rear end portions as fulcrums as described above so that their front end portions move toward the bottom plate 11*a* and the surface of the photosensitive drum 12 while the cushion guides 22 absorb the impact from the recording paper sheet P by the elasticity of the leaf spring portions 22*f*.

In other words, the leaf spring portion 22 of each cushion guide 22 receives a force from the trailing end portion of the recording paper sheet P to elastically deform and each cushion guide 22 displaces upward in FIGS. 3 and 6 to move back. Thus, impact caused by the strike of the trailing end portion of the recording paper sheet P is significantly reduced. Therefore, even if toner adheres to and becomes deposited on the distal ends of the separating claws 21, a phenomenon of dropping of the toner from the distal ends of the separating claws 21 due to the above impact can be prevented, thus avoiding that the trailing end portion of the recording paper sheet P is contaminated with the toner.

For example, in general image forming apparatuses, just after passing through the nip area between the photosensitive drum and the transfer roller, the trailing end portion of the recording paper sheet may bounce up by the elasticity of the recording paper sheet. If, thus, the bouncing trailing end portion of the recording paper sheet strikes the separating claws, the separating claws are subjected to impact of the strike to drop toner deposited thereon, so that the recording paper sheet may be contaminated with the dropped toner.

However, the general image forming apparatuses are provided with no mechanism coping with the contamination of the recording paper sheet due to strike on the separating claws. There is a conventional image forming apparatus configured to allow the trailing end portion of the recording paper sheet to strike a sheet trailing end restricting member and avoid strike on the separating claws. However, if the trailing end portion of the recording paper sheet bounces up when the recording paper sheet is separated off the photosensitive drum, the trailing end portion may not directly strike the separating claws but may strike the sheet trailing end restricting member, in which case the sheet trailing end restricting member is subjected to impact of the strike and the impact is transmitted to the separating claws to drop toner from the separating claws. Alternatively, even in the case of an image forming apparatus provided with a star-shaped roller extending beyond each separating claw toward the conveyance path for the recording paper sheet, there arises a problem that when the star-shaped rollers experience impact of the strike, toner may be dropped from the separating claws likewise.

To sum up, such a general image forming apparatus as described above is provided with sheet trailing end restricting members, star-shaped rollers or so on to prevent the trailing end portion of a recording paper sheet from striking the separating claws, but cannot prevent a phenomenon that toner is dropped from the separating claws by impact caused when the trailing end portion bounces and strikes the apparatus component.

Unlike the above conventional techniques, in accordance with the embodiment of the present disclosure, even if its component is subjected to impact by the bouncing of the trailing end portion of the recording paper sheet and strike thereof on the component, dropping of toner from the separating claws can be prevented.

Furthermore, in order to minimize the contact of the separating claws 21 with the trailing end portion of the recording paper sheet P, it may be preferred to locate the separating claws 21, for example, more upward in FIG. 4. Since, in accordance with this embodiment, the occurrence of the above phenomenon can be prevented, the need to locate the separating claws 21 more upward is eliminated, which increases the design flexibility.

Although in the above embodiment the leaf spring portion 22*f* is formed by bending a portion of a plate-like member forming the cushion guide 22, an elastic member separate from the cushion guide 22 and formed of, for example, a foaming resin or a spring may be provided to elastically support the cushion guide 22.

Figure 10:
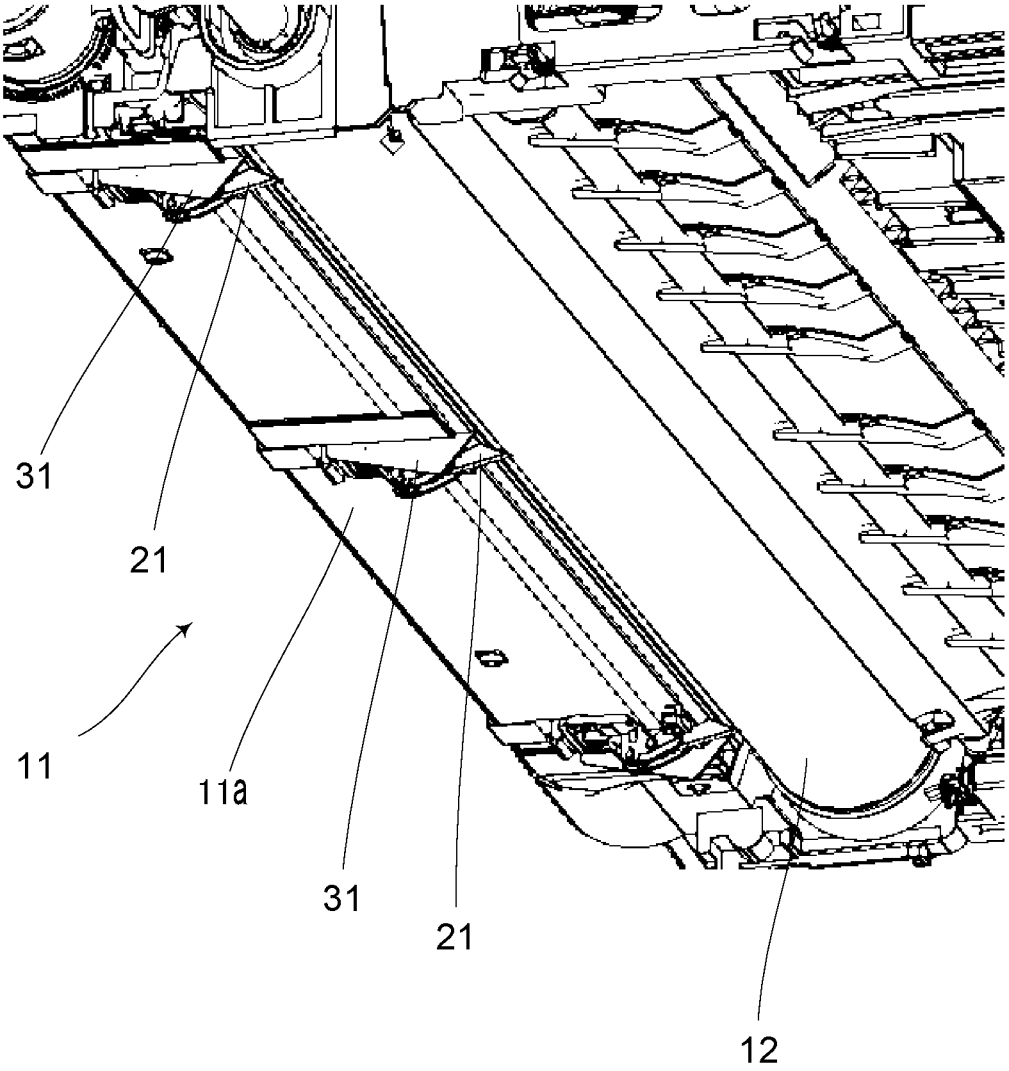
Fig.10 Related art
FIG. 10 is a perspective view showing a process unit according to a comparative example.
Figure 11:
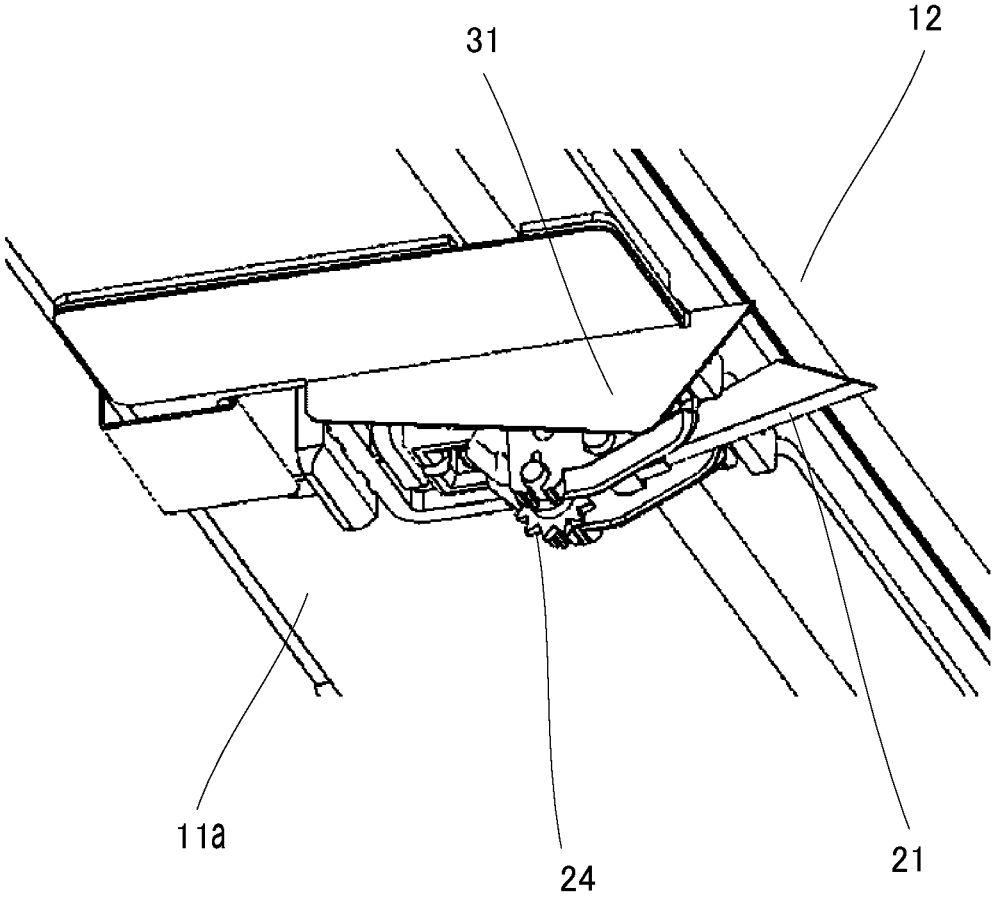
Fig.11 Related art
FIG. 11 is an enlarged perspective view of separating claws and surrounding regions of the process unit according to the comparative example.

FIG. 10 is a perspective view showing a process unit 11 according to a comparative example. FIG. 11 is an enlarged perspective view of separating claws 21 and surrounding regions of the process unit 11 according to the comparative example.

In the process unit 11 according to this comparative example, guide portions 31 are provided, one next to each separating claw 21. The guide portions 31 have a substantially triangular shape like the cushion guides 22 in the above embodiment but are different from the cushion guides 22 in the above embodiment in that they are fixed against up-and-down displacement and are not elastically held.

In this configuration, the recording paper sheet P can be peeled off the surface of the photosensitive drum 12 by the distal ends of the separating claws 21 and subsequently smoothly guided to and conveyed along the conveyance path 17 by the guide portions 31.

However, when the trailing end portion of the recording paper sheet P bounces up and strikes the guide portions 31 by the elasticity of the recording paper sheet P, impact caused by the strike of the trailing end portion of the recording paper sheet P is transferred, without being reduced, through the guide portions 31 to the bottom plate 11*a* of the process unit 11 and also transferred through the holders 23 to the separating claws 21, so that the separating claws 21 vibrate. As a result, toner adhering to and becoming deposited on the distal ends of the separating claws 21 drops to contaminate the trailing end portion of the recording paper sheet P.

In this relation, for example, if the thickness of the bottom plate 11*a* of the process unit 11 is increased to increase the rigidity and strength of the bottom plate 11*a*, it may be possible to make the bottom plate 11*a* difficult to vibrate even when subjected to impact from the trailing end portion of the recording paper sheet P, thus reducing the vibrations of the separating claws 21. However, the increase in the thickness of the bottom plate 11*a* raises the cost of the process unit 11 and thus raises the cost of the image forming apparatus 1.

In contrast, in the above embodiment, impact caused by the strike of the trailing end portion of the recording paper sheet P can be reduced not by increasing the thickness of the bottom plate 11*a* of the process unit 11 but simply by adding the cushion guides 22 formed by processing plate-like members, which reduces the cost rise.

The structure and configuration described with reference to FIGS. 1 to 9 are simply illustrative and are not intended to limit the present disclosure to them.

What is claimed is:

1. An image forming apparatus comprising:

an image carrier configured to carry a toner image formed thereon;

a transfer section configured to be pressed against the image carrier to form a nip area with the image carrier and transfer the toner image on the image carrier to a recording paper sheet being conveyed through the nip area;

a separating claw provided beside and against a surface of the image carrier and configured to separate the recording paper sheet having passed through the nip area off the surface of the image carrier in a direction away from the surface of the image carrier; and a cushion guide provided next to the separating claw to extend beyond the separating claw in the direction away from the surface of the image carrier, held, independently from the separating claw, elastically and displaceably away from the surface of the image carrier, and configured to come into contact with the recording paper sheet to guide the recording paper sheet downstream in a direction of conveyance of the recording paper sheet, wherein the cushion guide is formed of a plate-like member provided in a position perpendicular to the surface of the image carrier, the cushion guide extends in the direction of conveyance of the recording paper sheet and a front end portion thereof located on an upstream side thereof in the direction of conveyance has an inclined portion configured to guide a leading end of the recording paper sheet to the direction away from the surface of the image carrier, a rear end portion of the cushion guide located on a downstream side thereof in the direction of conveyance is mounted to an outline portion of an image forming unit angularly movably with the rear end portion as a fulcrum, the image forming unit holding the cushion guide and the image carrier, the cushion guide is provided with a leaf spring portion formed by bending a portion of the plate-like member, the leaf spring portion is connected at a root end thereof to a side edge of the front end portion of the cushion guide and the other end of the leaf spring portion extending from the side edge is pressed against a part of the outline portion, so that the cushion guide can move in the direction away from the surface of the image carrier while being elastically held, when the recording paper sheet strikes the inclined portion, the cushion guide angularly moves with the rear end portion thereof as a fulcrum so that the front end portion thereof moves toward the outline portion and the surface of the image carrier while the cushion guide absorbs impact from the recording paper sheet by elasticity of the leaf spring portion, the front end portion of the cushion guide located on the upstream side thereof in the direction of conveyance is provided, at a side edge thereof close to the surface of the image carrier, with a recess cut in the direction away from the surface of the image carrier and an outline portion of an image forming unit holding the cushion guide and the image carrier is provided at a portion thereof facing the recess with an extending portion having a greater amount of extension in a direction away from the outline portion than an amount of cutaway of the recess in the direction away from the outline portion, the leaf spring portion of the cushion guide keeps the front end portion of the cushion guide away from the outline portion and the surface of the image carrier while the extending portion is inserted in the recess but held out of contact with a bottom of the recess, when the recording paper sheet strikes the inclined portion, the cushion guide angularly moves with the rear end portion thereof as a fulcrum by an angular movement amount up to when the bottom of the recess comes in direct contact with the extending portion, and when the bottom of the recess comes in direct contact with the extending portion, the cushion guide is held out of contact with the outline portion and the image carrier, and an extending edge, which is a portion of the cushion guide located farthest away from the outline portion and the image carrier, extends beyond the separating claw in the direction away from the image carrier.

2. The image forming apparatus according to claim 1, wherein when the recording paper sheet strikes the inclined portion and the cushion guide thus angularly moves with the rear end portion thereof as a fulcrum so that the front end portion thereof moves toward the outline portion and the surface of the image carrier, the bottom of the recess abuts against a distal end of the extending portion to restrict further angular movement of the cushion guide, so that an edge portion of the cushion guide located farthest away from the outline portion and the image carrier is kept extending beyond the separating claw in the direction away from the surface of the image carrier.

3. The image forming apparatus according to claim 1, wherein the rear end portion of the cushion guide located on the downstream side thereof in the direction of conveyance is provided with an engagement recess formed to open downward in the direction of conveyance, and the engagement recess is engaged with a portion of a holder provided on the image forming unit and supporting the separating claw, so that the cushion guide becomes angularly movable.

* * * * *